United States Patent [19]

Sacripante et al.

[11] Patent Number: 5,045,428

[45] Date of Patent: Sep. 3, 1991

[54] ENCAPSULATED TONER COMPOSITIONS AND PROCESSES THEREOF

[75] Inventors: Guerino Sacripante, Cambridge; Barkev Keoshkerian, Thornhill; Beng S. Ong, Mississauga, all of Canada

[73] Assignee: Xerox Corporation, Stamford, Conn.

[21] Appl. No.: 440,552

[22] Filed: Nov. 22, 1989

[51] Int. Cl.[5] ..... G03G 9/08

[52] U.S. Cl. ..... 430/138; 428/423.1

[58] Field of Search ..... 430/138; 428/423.1

[56] References Cited

U.S. PATENT DOCUMENTS

| | | | |
|---|---|---|---|
| 3,893,933 | 7/1975 | Brown | 252/62.1 |
| 3,974,078 | 8/1976 | Crystal | 430/109 |
| 4,079,037 | 3/1978 | Frye et al. | 528/31 |
| 4,307,169 | 12/1981 | Matkan | 430/111 |
| 4,465,756 | 8/1984 | Mikami et al. | 430/138 |
| 4,601,968 | 7/1986 | Hyosu | 430/137 |
| 4,626,489 | 12/1986 | Hyosu | 430/137 |
| 4,727,011 | 2/1988 | Mahabadi et al. | 430/138 |
| 4,758,491 | 7/1988 | Alexandrovich et al. | 430/110 |
| 4,758,506 | 7/1988 | Lok et al. | 430/903 |
| 4,761,358 | 8/1988 | Hosoi et al. | 430/109 |
| 4,770,968 | 9/1988 | Georges et al. | 430/108 |
| 4,803,244 | 2/1989 | Umpleby | 525/106 |
| 4,814,253 | 3/1989 | Gruber et al. | 430/138 |
| 4,816,366 | 3/1989 | Hyosu et al. | 430/137 |
| 4,925,735 | 5/1990 | Koshizuka et al. | 428/423.1 |

*Primary Examiner*—John Goodrow

*Attorney, Agent, or Firm*—E. O. Palazzo

[57] ABSTRACT

An encapsulated toner composition comprised of a core comprised of a resin binder formed by the hydrosilylation reaction of an olefin, pigment, dyes, or mixtures thereof; and a polymeric shell.

52 Claims, No Drawings

ENCAPSULATED TONER COMPOSITIONS AND PROCESSES THEREOF

BACKGROUND OF THE INVENTION

The present invention is generally directed to toner compositions, and more specifically to encapsulated toner compositions and processes thereof. In one embodiment the present invention is directed to a process for the preparation of encapsulated toner compositions by a shell-forming interfacial polycondensation and a core resin-forming hydrosilylation reaction. Another specific embodiment of the present invention relates to a process for the preparation of encapsulated toner compositions comprised of a core comprised of colorants, including pigments, dyes, or mixtures thereof, and a resin obtained by hydrosilylation or polyhydrosilylation of olefins; which core is encapsulated in a polymeric shell comprised of, for example, a polyurea, a polyurethane, a polyamide, a polyester material, or mixtures thereof. In another embodiment of the present invention, there is provided a process for the preparation of an encapsulated toner composition comprised of a polymeric shell and a core comprised of colorants including pigments, dyes, mixtures thereof, and a polymer resin obtained by the reaction of a silylhydride-functionalized reagent and an olefin. In another specific embodiment of the present invention, there is provided an encapsulated toner composition wherein the core resin is comprised of a siloxane-containing polymer derived from the reaction of a silylhydride-functionalized siloxane and an olefinic compound. Examples of advantages associated with the toners and processes of the present invention include the selection of different core resins, and the utilization of a number of different colorants which are compatible with the hydrosilylation reaction. The relatively high reactivity of the hydrosilylation reaction enables the core resin forming reaction of the present invention to be accomplished at ambient temperature in some embodiments, thus reducing the energy cost associated therewith. The present process also enables a facile and effective incorporation of a desirable low surface energy siloxane material into the core resin structure without having to utilize additional release agents. With the core resin material obtained via the process of the present invention, the problem of image ghosting often observed in ionographic printing technologies is eliminated, or substantially minimized. In addition, the core resin obtained by the process of the present invention is also not leaky, that is the aforementioned core remains encapsulated and its defusion through the polymeric shell is avoided or minimized, thus eliminating or minimizing the problem of toner agglomeration associated with many encapsulated toner compositions. The core resin obtained by the process of the present invention, in some embodiments, also possesses superior surface release properties, thus permitting the use of the resulting toner compositions in imaging devices wherein a release fluid such as a silicone oil is avoided. The toner compositions obtained by the process of the present invention also display excellent powder flow characteristics and excellent toner transfer efficiency, for example over 99 percent in some embodiments from, for example, dielectric receivers or photoreceptors to paper substrate during the image development process. The toner compositions of the present invention can be selected for a variety of known reprographic imaging processes including electrophotographic and ionographic processes. Preferably, the toner compositions of the present invention are selected for pressure fixing processes wherein the image is fixed with pressure. Pressure fixing is common in ionographic processes in which latent images are generated on a dielectric receiver such as silicon carbide, reference U.S. Pat. No. 4,885,220 entitled Amorphous Silicon Carbide Electroreceptors, the disclosure of which is totally incorporated herein by reference. The latent images are then toned with a conductive toner by inductive single component development, and are transferred and fixed simultaneously (hereafter refers to as transfix) in one single step onto paper with pressure. Specifically, the process of the present invention can be utilized to formulate toner compositions for use in commercial ionographic printer machines such as, for example, the commercially available Delphax printers including the Delphax S9000, S6000, S4500, S3000, and Xerox Corporation printers including the Xerox Corporation 4060 TM and 4075 TM wherein, for example, transfixing is utilized. In another embodiment of the present invention, the toner compositions can be utilized in xerographic processes wherein image toning and transfer are accomplished electrostatically, and transferred images are fixed in a separate step by means of a pressure roll with or without the assistance of photochemical or thermal energy fusing.

The toner compositions of the present invention can, in one embodiment, be prepared by first dispersing the precursor materials comprised of shell precursors, core resin precursors, colorants and hydrosilylation catalysts into stabilized microdroplets of controlled droplet size and size distribution, followed by shell formation around the microdroplets via interfacial polymerization, and subsequently generating the core polymer resin by hydrosilylation within the newly formed microcapsules. Thus, in one embodiment the present invention is directed to a process for the simple, and economical preparation of pressure fixable encapsulated toner compositions by an interfacial polymerization/hydrosilylation method wherein there are selected as the core resin precursors an olefin and a silylhydride-functionalized reagent capable of undergoing hydrosilylation with the olefin, a colorant, and a shell-forming monomer component or components capable of undergoing interfacial polymerization with another shell monomer component in the aqueous phase. Another specific embodiment of the present invention relates to the utilization of a diolefinic compound and a bis(silylhydride)-functionalized reagent as the core resin-forming precursors, the reaction of which via polyhydrosilylation enables the desired core resin. A further specific embodiment of the present invention encompasses the use of a silylhydride-, bis(silylhydride)- or poly(silylhydride)-functionalized siloxane or polysiloxane as one of the core resin-forming precursors, the reaction of which with an olefinic compound affords the desirable low surface energy siloxane-containing core resin for the toner composition of the present invention. Other process embodiments of the present invention relate to, for example, interfacial polymerization/hydrosilylation reaction processes for obtaining encapsulated colored toner compositions. Further, in another process aspect of the present invention the encapsulated toners can be prepared with or without a minimum amount of organic solvent as the diluting vehicle or as a reaction medium, thus eliminating the explosion hazards associated therewith. Moreover, with the aforementioned process in an embodiment of the present invention there is obtained improved product yield per unit volume of reactor size since, for example, the extraneous solvent component can be replaced by a liquid core and shell precursors. The aforementioned toners prepared in accordance with the process of the present invention are useful for permitting the development of images in reprographic imaging systems, inclusive of electrostatic imaging processes wherein pressure fixing, especially pressure fixing in the absence of heat, is selected.

Encapsulated and cold pressure fixable toner compositions are known. Cold pressure fixable toners have a number of advantages in comparison to toners that are fused by heat, primarily relating to the utilization of less energy since the toner compositions used can be fused at room temperature. Nevertheless, many of the prior art cold pressure fixable toner compositions suffer from a number of deficiencies. For example, these toner compositions must usually be fixed under high pressure, which has a tendency to severely disrupt the toner fixing characteristics of the toner selected. This can result in images of low resolution, or no images whatsoever. Also, with some of the prior art cold pressure toner compositions substantial image smearing can result from the high pressures used. The high fixing pressure also gives rise to glossy images and objectionable paper calendering problem. Additionally, the preparative processes of the prior art pressure fixing toner compositions employed relatively large quantities of organic solvents as the reaction media, and these would drastically increase the toner's manufacturing cost because of the expensive solvent separation and recovery procedure, and the necessary precautions that have to be undertaken to prevent the solvent associated hazards. Moreover, the involvement of organic solvent in the prior art processes also decreases the product yield per unit volume of reactor size. In addition, the large amount of solvents used in many prior art processes also have deleterious effects on toner particle morphology and bulk density as a result of their removal from the toner particles during the toner isolation stage, thus causing shrinkage or collapse of the toner particles, resulting in a toner of very low bulk density, which disadvantages are substantially eliminated with the process of the present invention. Furthermore, with many of the prior art processes narrow size dispersity toner particles cannot be easily obtained by conventional bulk homogenization techniques as contrasted with the process of the present invention wherein narrow size dispersity toner particles are obtained. More specifically, thus with the encapsulated toners of the present invention, control of the toner physical properties of both the core and shell materials can be desirably achieved. Specifically, with the encapsulated toners of the present invention undesirable leaching or loss of core components is avoided, and image ghosting is eliminated in many instances because of the low surface energy siloxane-containing core resin illustrated herein. Image ghosting is one of the common phenomena in pressure fixing ionographic printing processes. This refers to the unwarranted repetitious generation of images, and is related to the contamination of dielectric receiver by residual toner materials which cannot be readily removed in the cleaning process. The result is the retention of some latent images on the dielectric receiver surface after cleaning, and the subsequent unwarranted development of these images. One of the common causes of image ghosting is related to the adherence of some residual toner material to the dielectric receiver during the image development process. In many of the prior art microencapsulation processes utilizing free-radical polymerization for the formation of core resin, the resultant encapsulated toners often contain residual monomers, which monomers often leach out to the toner surface causing toner agglomeration as well as image ghosting when used in pressure transfixing ionographic printing processes. The core resin forming hydrosilylation process of the present invention overcomes this disadvantage in that the core resin monomers or precursors are completely or substantially completely consumed in the formation of core resin at the very early stage of hydrosilylation, thus eliminating the above noted disadvantages.

In a patentability search report there was recited the following prior art, all United States patents: U.S. Pat. No. 4,816,366 directed to a toner obtained by suspension polymerization wherein silane coupling agents may be selected, see column 3, beginning at line 6; also note the disclosure in column 3, beginning at line 56, wherein an inorganic fine powder such as silicas is attached to the surface of polymerizable monomer composition particles to effect stabilization thereof; note the preferred process method in column 5, beginning at line 59, and examples of silicone particles that may be selected, reference column 7, and silane coupling agents, see columns 7 and 8, for example; the use of polymerizable monomers with vinyl groups is disclosed, for example, in column 12, lines 27 to 62; and crosslinking agents such as divinylbenzene may also be selected, see column 13, lines 34 to 54, for example; U.S. Pat. No. 4,465,756 directed to encapsulated toners with improved chargeability comprising a pressure fixable adhesive core material containing a colorant and a pressure rupturable shell enclosing the core material, the outer surface of the shell being provided with the surface active agent with the hydrophobic group, reference columns 3 and 4; also note specifically the disclosures in columns 5 through 9; the use of a catalyst for the formation process, reference column 5, lines 45 to 46, for example; interfacial polymerization techniques wherein there is reacted a hydrophobic liquid with a hydrophobic liquid for the purpose of forming toner shells, reference for example column 5, lines 47 to 56; U.S. Pat. No. 4,626,489 directed to a polymerizable mixture containing a monomer, a polymerization initiator and a colorant, which mixture is subjected to suspension polymerization, and wherein an additional monomer is absorbed onto the resulting polymer particles, reference the Abstract of the Disclosure; also note columns 3 to 8; the use of crosslinking agents having two or more polymerizable double bonds such as divinyl ether, reference column 3, lines 45 to 57, for example; and the use of silane coupling agents to treat magnetic material which may be incorporated into the polymerizable mixture, reference for example column 4, lines 44 to 46; and U.S. Pat. No. 4,727,011 directed to an improved process for the preparation of encapsulated toner compositions which comprises mixing in the absence of a solvent a core monomer and initiator pigment particles, a first shell monomer stabilizer in water, and accomplishing other steps including effecting a free radical polymerization of the core monomer in an interfacial polymerization reaction between a first and second shell monomer, reference the Abstract of the Disclosure, for example; note the illustrative examples of core monomers in column 6, beginning at line 21, and the examples of pigments in column 6, beginning at line 46, or examples of shell monomers are outlined, for example, in column 7, beginning at line 23. Also mentioned are U.S. Pat. Nos. 4,761,358; 3,893,933 and 4,601,968, which relate to encapsulated toners and interfacial polymerization processes in some instances.

With further reference to the prior art, there is disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization process are also selected for the preparation of the toners of this patent. Also, there is disclosed in the prior art encapsulated toner compositions containing costly pigments and dyes, reference for example the color photocapsule toners of U.S. Pat. Nos. 4,399,209; 4,482,624; 4,483,912 and 4,397,483.

Moreover, illustrated in U.S. Pat. No. 4,758,506, the disclosure of which is totally incorporated herein by reference, are single component cold pressure fixable toner compositions, wherein the shell selected can be prepared by an interfacial polymerization process. Also, known encapsulated toners comprised of magnetite and a polyisobutylene of a specific molecular weight encapsulated in a polymeric shell material generated by an interfacial polymerization process are known.

There is illustrated in U.S. Pat. No. 5,023,159, entitled Encapsulated Toner Composition, the disclosure of this application being totally incorporated herein by reference, an encapsulated toner comprised of a core comprised of a silane modified polymer resin and pigment or dye; and a polymeric shell wherein the silane modified polymer resin has incorporated therein an oxysilyl, a dioxysilyl or a trioxysilyl, see for example Claim 1, and note, for example, claim 5 wherein specific functionalized silylenes are recited; and in U.S. Pat. No. 5,013,630, entitled Encapsulated Toner Compositions, the disclosure of which is incorporated herein by reference, there are illustrated encapsulated toners with a polysiloxane incorporated core binder.

Liquid developer compositions are also known, reference for example U.S. Pat. No. 3,806,354, the disclosure of which is totally incorporated herein by reference. This patent illustrates liquid inks comprised of one or more liquid vehicles, colorants such as pigments, and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as poly(vinyl pyrrolidone). Additionally, there is described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history and evolution of liquid developers is provided in the '210 patent, reference columns 1 and 2 thereof.

Accordingly, there is a need for preparative processes and encapsulated toner compositions with many of the advantages illustrated herein. Specifically, there is a need for simple and economical processes for encapsulated toners, which permit a wide selection of shell and core resin materials. Another need resides in the provision of an interfacial polymerization/hydrosilylation process for black and colored encapsulated toner compositions comprising a hard polymeric shell and a soft core comprised of core resin and colorants, and wherein organic solvents are eliminated in their preparation in some embodiments. Another specific need is to provide encapsulated toner compositions comprising a core of a siloxane-containing core resin obtained by hydrosilylation of olefins, and colorants, and encapsulated thereover a polymeric shell coating. Also, there is a need to provide encapsulated toner compositions, including colored toners wherein image ghosting and the like is eliminated or minimized. An additional need is to provide pressure fixable encapsulated toners which offer quality images with excellent fixing levels, for example, over 70 percent at low fixing pressure of, for example, 2,000 psi. Furthermore, there is a need for encapsulated toners, including colored toners with excellent release characteristics enabling their selection in imaging systems without the use of surface release fluids such as silicone oils to prevent image offsetting to the fixing or fuser roll. Another need is to provide encapsulated toners, including colored toners with substantially no toner agglomeration, long shelf life exceeding, for example, one year, and wherein the core resin is a siloxane-containing polymer. Also, there is a need for conductive encapsulated toners that have been surface treated with additives such as carbon blacks, graphite or the like to impart to their surface certain conductive characteristics such as providing a volume resistivity of from about $1\times10^3$ ohm-cm to about $1\times10^8$ ohm-cm. Furthermore, there is a need for encapsulated toners wherein surface additives, such as metal salts or metal salts of fatty acids and the like, are utilized to assist in the release of the images from the imaging component to the paper substrate. There is also a need for enhanced flexibility in the design and selection of the shell and core materials for pressure fixable encapsulated toners as well as the flexibility in the control of the toner physical properties such as the bulk density, particle size, and size dispersity.

SUMMARY OF THE INVENTION

It is an object of the present invention to provide encapsulated toner compositions and preparative processes with many of the advantages illustrated herein.

In another object of the present invention there are provided simple and economical processes for black and colored toner compositions prepared by an interfacial polymerization/hydrosilylation process in which the shell is formed by interfacial polymerization, and the core resin is obtained by a hydrosilylation reaction.

In a further object of the present invention there are provided encapsulated toner compositions comprised of a core of a polymer resin obtained by hydrosilylation, pigments and/or dyes, and thereover a polymeric shell prepared, for example, by interfacial polymerization.

In another object of the present invention there are provided encapsulated toner compositions comprised of a siloxane-containing core resin prepared by hydrosilylation process.

Another object of the present invention is to provide encapsulated toners wherein image ghosting is eliminated in some embodiments, or minimized in other embodiments.

A further object of the present invention relates to the provision of encapsulated toners wherein surface release agents such as silicone oil and the like are eliminated, or minimized in other embodiments.

An additional object of the present invention is to provide encapsulated toners with excellent powder flow properties wherein toner agglomeration is completely eliminated.

Also, another object of the present invention is the provision of encapsulated toners wherein core component leaching or loss is eliminated in some embodiments, or minimized in other embodiments.

Moreover, another object of the present invention is the provision of encapsulated toners wherein image offsetting is eliminated in some embodiments, or minimized in other embodiments.

Additionally, another object of the present invention is the provision of encapsulated toners with extended shelf life.

Further, another object of the present invention is the provision of encapsulated toners with excellent release properties.

Also, another object of the present invention is the provision of colored, that is other than black, encapsulated toners.

It is another object of the present invention to provide encapsulated toners wherein contamination of the imaging member, such as a dielectric receiver or a photoreceptor, is eliminated or minimized.

Another object of the present invention is the provision of encapsulated toners that can be selected for imaging processes, especially processes wherein pressure fixing is selected.

An additional object of the present invention resides in the provision of black and colored encapsulated toner compositions which offer a high image fix level of, for example, over 70 percent and up to 90 percent in some embodiments at a relatively low fixing pressure of, for example, 2,000 psi.

A further object of the present invention is to provide encapsulated toner compositions which are suitable for duplex imaging and printing process.

Another object of the present invention is to provide colored and black encapsulated toner compositions which are suitable for inductive single component development.

Additionally, in another object of the present invention there are provided insulative encapsulated toner compositions for use in electrostatic development.

These and other objects of the present invention are accomplished by the provision of toners and more specifically encapsulated toners and process thereof. In one embodiment of the present invention there are provided encapsulated toners with a soft core containing a polymer resin, a colorant, and a polymeric shell thereover. Specifically, in one embodiment there are provided in accordance with the present invention encapsulated toners comprised of a core containing a polymer resin comprised of a siloxane-containing polymer resin, preferably obtained by hydrosilylation, pigment particles dyes, or mixtures thereof, and thereover a shell preferably obtained by interfacial polymerization.

The aforementioned toners of the present invention can be prepared by an interfacial polymerization/hydrosilylation process, which comprises (1) mixing or blending of an olefinic component or components, a silylhydride-functionalized reagent, a hydrosilylation catalyst, colorants, and a shell monomer component or components; (2) dispersing the resulting mixture by high shear blending into stabilized microdroplets in an aqueous medium with the assistance of suitable dispersants or emulsifying agents; (3) thereafter subjecting the aforementioned stabilized microdroplets to a shell forming interfacial polycondensation; and (4) subsequently forming the core resin by hydrosilylation at ambient or elevated temperature within the newly formed microcapsules. The shell forming interfacial polycondensation is generally accomplished at ambient temperature, but elevated temperatures may also be employed depending on the nature and functionality of the shell monomer selected. For the core polymer resin forming hydrosilylation, the process is generally effected at a temperature of from ambient temperature to about 100° C., and preferably from ambient temperature to about 90° C. In addition, more than one catalyst may be utilized to enhance the hydrosilylation reaction, and to generate the desired molecular weight and molecular weight distribution. Catalysts such as chloro platinic acid, dichlorobis(ethylenedichloro) platinum, ethylene bis(triphenylphosphino) platinum, ethylene tris(cyclohexylphosphino) platinum, potassium trichloro platinum-dimethylsulfoxide complex, dicobaltoctacarbonyl, bis(triphenylphosphino)dichloro nickel, ethyl dichlorobis(dimethylamino) nickel, dichlorodipyridine nickel, dichlorobis(dimethylphosphino) ferrocene, and the like in an effective amount of from, for example, about 0.01 percent to 10 percent, and preferably from about 0.01 to about 1 percent by weight of the core resin are usually employed.

Further, in accordance with the present invention there are provided processes for black and colored pressure fixable toner compositions which are obtained with a minimum of or without organic solvents as the diluting vehicles or as reaction media. These processes involve dispersing a mixture of organic materials and colorants to form stabilized microdroplets in an aqueous medium containing a dispersant or emulsifying agent. The organic mixture is comprised of from about 15 to about 95 weight percent of core precursors, which include a silylhydride-functionalized reagents such as diphenylmethylsilane, trimethylsilane, triethylsilane, trioctylsilane, trimethoxysilane, triethyoxysilane, diphenylsilane, dimethylsilane, diethylsilane, dipropylsilane, dibutylsilane, dipentylsilane, dihexylsilane, dioctylsilane, diisopropylsilane, tetramethyldisiloxane, tetraethyldisiloxane, tetrapropyldisiloxane, tetrabutyldisiloxane, tetrapentyldisiloxane, tetramethyldisilylethylene, silylhydride-terminated polydimethylsiloxanes, methyldimethoxy-terminated methylhydrosiloxane, dimethylsiloxy-terminated methylhydrophenylmethylsiloxane copolymer, and the like; an olefin such as hexene, heptene, hexadiene, cyclopentadiene, divinylether, diallylether, divinylbenzene, diallylbenzene, divinyltoluene, bis(vinyloxy)benzene, bis(allyloxy)benzene, bis(vinyloxy)toluene, divinyl succinate, divinyl malonate, methyladipate, diallyl succinate, diallyl glutarate, diallyl adipate, poly(butadiene), styrene-butadiene copolymers capable of undergoing hydrosilylation in the presence of a hydrosilylation catalyst of about 0.01 to 1 weight percent, and about 2 to 20 weight percent of a shell forming monomer component. The colorant(s) are employed at an effective amount of from about 1 to about 65 percent by weight to impart the desired color intensity and quality. The shell formation around the dispersed, stabilized microdroplets via interfacial polycondensation is initiated by adding another shell forming, water miscible monomer component into the aqueous phase. Subsequently, the reaction mixture is generally subjected to heating to initiate or accelerate the core resin forming hydrosilylation reaction.

Illustrative examples of silylhydride-functionalized reagents selected for the core resin forming hydrosilylation include diphenylmethylsilane, trimethylsilane, triethylsilane, trioctylsilane, trimethoxysilane, triethyoxysilane, diphenylsilane, dimethylsilane, diethylsilane, dipropylsilane, dibutylsilane, dipentylsilane, dihexylsilane, dioctylsilane, diisopropylsilane, tetramethyldisiloxane, tetraethyldisiloxane, tetrapropyldisiloxane, tetrabutyldisiloxane, tetrapentyldisiloxane, tetramethyldisilylethylene, silylhydride-terminated polydimethylsiloxanes of weight average molecular weights of, for example, from about 200 to about 20,000; polymethylhydrosiloxanes of weight average molecular weights of, for example, from 200 to about 10,000; polymethylhydrosiloxane copolymers such as methylhydrodimethylsiloxane copolymer, methylhydromethylcyanopropylsiloxane copolymer, methylhydromethylcotylsiloxane copolymer, alkoxy and siloxy-terminated hydrosiloxane polymers such as methydimethoxy-terminated methylhydrosiloxane, dimethylsiloxy-terminated methylhydrophenylmethylsiloxane copolymer, mixtures thereof and the like. The abovementioned reagents can be employed in an effective amount of, for example, from about 0.01 to about 50 weight percent, and preferably from about 1 to about 30 weight percent of the toner materials.

Illustrative specific examples of the olefinic reactants selected for the core resin forming hydrosilylation include hexene, heptene, octene, hexadiene, heptadiene, octadiene, cyclopentadiene, divinylether, diallylether, dibutenylether, dipentenylether, dihexenylether, diheptenylether, dioctenylether, vinylbutenylether, vinylhexenylether, allylbutenylether, allylhexenylether, divinylbenzene, diallylbenzene, divinyltoluene, diallyltoluene, divinylnaphthalene, diallylnaphthalene, bis(vinyloxy)benzene, bis(allyloxy)benzene, bis(vinyloxy)toluene, divinyl succinate, divinyl malonate, divinyl glutarate, divinyl adipate, divinyl pimelate, divinyl suberate, divinyl methylglutarate, methyladipate, diallyl succinate, diallyl glutarate, diallyl adipate, poly(butadiene), styrene-butadiene copolymers, mixture thereof and the like. An effective amount of olefinic reagent that can be selected for the hydrosilylation is, for example, from 0.01 to about 50 weight percent, and preferably from 1 to about 30 weight percent of toner materials.

The catalysts that can be utilized for the core resin forming hydrosilylation include molybdic acid, chloroplatinic acid, organoplatinum complexes such as dichlorobis(ethylenedichloro) platinum, ethylene bis(triphenylphosphino) platinum, ethylene tris(cyclohexylphosphino) platinum, potassium trichloro platinum-dimethylsulfoxide complex, dicobaltoctacarbonyl, bis(triphenylphosphino)dichloro nickel, ethyl dichlorobis(dimethylamino) nickel, dichlorodipyridine nickel, dichlorobis(dimethylphosphino) ferrocene, dichlorobis(tributylphosphino) nickel, tetrakis(triphenylphosphino) nickel, dichlorotetraaniline nickel, iron pentacarbonyl, manganese acetoacetate, ferrous acetoacetate, cobalt acetoacetate, bis(cycloocta-1,5-diene) nickel, chlorotris(triphenylphosphino) rhodium, chorotris(cyclohexylphosphino) rhodium, octacarbonyl dicobalt dihydrogen hexachloro osmium, rhodium trichloride, ruthenium trichloride, ferric chloride, nickel chloride, dihydrogen hexachloro iridium, and the like. Generally, any known homogeneous or heterogeneous hydrosilylation catalysts can be selected for the process of the present invention. The catalyst is employed in effective amounts of, for example, from about 0.01 to about 10 weight percent and preferably from about 0.01 to about 1 weight percent.

Various known colorants present in the core in an effective amount of, for example, from about 1 to about 65 percent by weight of toner, and preferably in an amount of from about 5 to about 60 weight percent, that can be selected include carbon black, magnetites, such as Mobay magnetites MO8029, MO8060; Columbian magnetites; Mapico Blacks and surface treated magnetites; Pfizer magnetites, CB4799, CB5300, CB5600, MCX6369, Bayer magnetites, Bayferrox 8600, 8610; Northern Pigments magnetites, NP-604, NP-608; Magnox magnetites TMB-100, or TMB-104; and other equivalent black pigments. As colored pigments there can be selected Heliogen Blue L6900, D6840, D7080, D7020, Pylam Oil Blue and Pylam Oil Yellow, Pigment Blue 1 available from Paul Uhlich & Company, Inc., Pigment Violet 1, Pigment Red 48, Lemon Chrome Yellow DCC 1026, E.D. Toluidine Red and Bon Red C available from Dominion Color Corporation, Ltd., Toronto, Ontario, NOVAperm Yellow FGL, Hostaperm Pink E from Hoechst, and Cinquasia Magenta available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of Mapico Black, and cyan components may also be used as pigments with the process of the present invention.

Examples of shell polymers include polyureas, polyamides, polyesters, polyurethanes, mixtures thereof, and other polycondensation products. The shell amounts are generally from about 5 to about 30 weight percent of toner, and have a thickness generally, for example, of less than about 5 microns, and more specifically from about 0.1 micron to about 3 microns. Other shell polymers, shell amounts, and thicknesses can be selected provided the objectives of the present invention are achievable.

The shell forming monomer components present in the organic phase are generally comprised of diisocyanates, diacyl chloride, bischloroformate, together with appropriate polyfunctional crosslinking agents such as triisocyanate, triacyl chloride and other polyisocyanates. Illustrative examples of the shell monomer components include benzene diisocyanate, toluene diisocyanate, diphenylmethane diisocyanate, cyclohexane diisocyanate, hexane diisocyanate, adipoyl chloride, fumaryl chloride, suberoyl chloride, succinyl chloride, phthaloyl chloride, isophthaloyl chloride, terephthaloyl chloride, ethylene glycol bischloroformate, and diethylene glycol bischloroformate. The water soluble shell forming monomer components, which are added to the aqueous phase, can be a polyamine or polyol including bisphenols, the nature of which is dependent on the desired shell materials for the desired applications. Illustrative examples of water soluble shell monomers include ethylenediamine, triethylenediamine, diaminotoluene, diaminopyridine, bis(aminopropyl)piperazine, bisphenol A, bisphenol Z, and the like. If desired, a water soluble crosslinking agent, such as triamine or triol, can also be added to improve the mechanical strength of shell structure. Illustrative shell materials are detailed in U.S. Pat. No. 5,013,630 and U.S. Pat. No. 5,023,159, both entitled Encapsulated Toner Compositions, the disclosures of which are totally incorporated herein by reference.

In one specific embodiment of the present invention, there is provided an improved process for the preparation of improved encapsulated toner compositions, which process comprises mixing and dispersing two or more, up to 25 for example, core resin precursors, one of which is a silylhydride-functionalized reagent, and another one is an olefinic compound, a hydrosilylation catalyst, pigment particles or dyes, and a shell monomer component into microdroplets of specific droplet size and size distribution in an aqueous medium containing a dispersant or stabilizer; the volume average diameter of the said microdroplet generally ranges from about 5 microns to about 30 microns, and its volume average droplet size dispersity ranges from about 1.2 to about 1.4 as inferred from the Coulter Counter measurements of the microcapsule particles after encapsulation; forming a microcapsule shell around the microdroplets via interfacial polymerization by adding a water soluble shell forming monomer component; and during which or subsequently affecting a core resin forming hydrosilylation reaction within the newly formed microcapsules by, for example, heating the reaction mixture from room temperature to about 90° C. for a period of from about 1 to about 10 hours. Stabilizers selected for the process of the present invention include water soluble polymers such as poly(vinyl alcohols), methyl cellulose, hydroxypropyl cellulose and the like.

Interfacial polymerization processes selected for the shell formation of the toners of the present invention are as illustrated, for example, in U.S. Pat. Nos. 4,000,087 and 4,307,169, the disclosures of which are totally incorporated herein by reference.

Surface additives that can be added to the toner compositions of the present invention include, for example, metal salts, metal salts of fatty acids, colloidal silicas, mixtures thereof and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and Aerosil R972.

Also, the toner compositions can be rendered conductive with, for example, a volume resistivity of from about $1\times10^3$ ohm-cm to about $1\times10^8$ ohm-cm by adding to the surface thereof in effective amounts of, for example, from about 1 to about 35 weight percent by, for example, known blending and mixing processes, components such as carbon blacks, graphite, copper iodide, and other conductive metal salts, conductive organic or organometallic materials.

The following examples are being submitted to further define various species of the present invention. These examples are intended to be illustrative only and are not intended to limit the scope of the present invention. Also, parts and percentages are by weight unless otherwise indicated.

EXAMPLE I

Hydride terminated polydimethylsiloxane (weight average molecular weight 400, available from Petrarch Inc.) (97 grams), allyl ether (23 grams), dihydrogen hexachloro platinate hydrate catalyst (100 milligrams), and Isonate 143-L (Dow) (47.1 grams) were mixed in a 2 liter container with a Brinkmann polytron equipped with a PT 35/4 probe at 4,000 rpm for 30 seconds. Bayferrox magnetite 8610 (300 grams) was then added, and the resulting mixture was homogenized by high sheer blending with the Brinkmann polytron at 8,000 rpm for 3 minutes. To the mixture was then added one liter of 0.12 percent aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33 grams) and water (80 milliliters) were then added with constant stirring for 10 minutes to initiate the microcapsule shell forming reaction. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder-forming hydrosilylation. The temperature of the mixture was gradually increased from room temperature to a final temperature of 90° C. over a period of 5.5 hours. Stirring was then continued for an additional 6 hours after which the mixture was cooled to room temperature (25° C.). The toner product resulting was transferred to a 4 liter beaker, and washed repeatedly with water until the washing was clear. The wet toner was sieved through a 180 micron sieve to remove coarse material, transferred to a 2 liter beaker, and diluted with water to a total volume of 1.8 liters. Colloidal graphite (22.7 grams, millimole), Aquadag E available from Acheson Colloids, diluted with 100 milliliters of water was added to the wet toner, and the mixture was spray dried in a Yamato Spray Dryer at an air inlet temperature of 160° C., and an air outlet temperature of 80° C. The air flow was retained at 0.75 $m^3$/minute, while the atomizing air pressure was kept at 1.0 killigram per centimeter squared ($kg/cm^2$). The collected encapsulated dry toner (364 grams) was screened through a 63 micron sieve, and particle size measurement by Coulter Counter provided a volume average particle diameter of 11.4 microns with a volume average particle size dispersity of 1.36.

Two hundred and forty (240) grams of the above toner was dry blended using a Greey blender, first with 0.96 gram of carbon black (Black Pearls 2000) for 2 minutes with the blending impeller operating at 3,500 RPM, and then with 3.6 grams of zinc stearate for another 6 minutes at the impeller speed of 3,000 RPM. The volume resistivity of the resulting toner was $5\times10^6$ ohm-cm. After dry blending, the toner was further sieved through a 63 micron sieve, and was ready for use. This toner was then evaluated in a Delphax S6000 printer with a dielectric receiver temperature of 55° C. and a transfix pressure of 2,000 psi. Print quality was evaluated from a checkerboard print pattern and image ghosting was examined visually. The image optical density was measured using a standard integrating densitometer. The toner of this Example provided an image fix level of 81 percent with clean image background and without image ghosting. This toner also displayed no tendency toward agglomeration on standing or in the development housing. In addition, the toner also exhibited excellent powder flow characteristics during use, and did not agglomerate even after heating to 55° C. for 48 hours.

EXAMPLE II

Hydride terminated polydimethylsiloxane (molecular weight 17,500, available from Petrarch Inc.) (120 grams), allyl ether (0.84 gram), chloroplatinic acid catalyst (100 milligrams), and Isonate 143-L (47.0 grams) were mixed in a 2 liter container with a Brinkmann polytron equipped with a PT 35/4 probe at 4,000 rpm for 30 seconds. Bayferrox magnetite 8610 (300 grams) was then added, and the resulting mixture was homogenized by high sheer blending with the Brinkmann polytron at 8,000 rpm for 3 minutes. To the mixture was then added one liter of 0.12 percent aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33 grams) and water (80 milliliters) was added over a period of 10 minutes with constant stirring. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder-forming hydrosilylation. The temperature of the mixture was gradually raised from room temperature to a final temperature of 90° C. over a period of 5.5 hours. Stirring was continued for an additional 6 hours after which the mixture was cooled to room temperature, and the resulting toner product was transferred to a 4 liter beaker, and was washed repeatedly with water until the washing was clear. The wet toner was then sieved through a 180 micron sieve to remove coarse material, and then transferred to a 2 liter beaker and diluted with water to a total volume of 1.8 liters. Colloidal graphite (22.7 grams), Aquadag E, available from Acheson Colloids, diluted with 100 milliliters of water was added to the beaker, and the mixture was spray dried in a Yamato Spray Dryer at an air inlet temperature of 160° C., and an air outlet temperature of 80° C. The air flow was retained at 0.75 $m^3$/minute, while the atomizing air pressure was kept at 1.0 kg/$cm^2$. The encapsulated collected dry toner (340 grams) was screened through a 63 micron sieve, and Coulter Counter measurement provided a volume average particle diameter of 20.1 microns with a volume average particle size dispersity of 1.30.

Two hundred and forty (240) grams of the above toner was dry blended and evaluated by repeating the procedure of Example I. The toner of this example provided a high image fix level of 75 percent with clean image background and without image ghosting. The toner also displayed no tendency toward agglomeration on standing or in the development housing for 48 hours.

EXAMPLE III

Tetramethyldisiloxane (46.0 grams), diallyl phthalate (84.0 grams), octacarbonyldicobalt catalyst (1.0 gram), and Isonate 143-L (47.0 grams) were mixed in a 2 liter container with a Brinkmann polytron equipped with a PT 35/4 probe at 4,000 rpm for 30 seconds. Bayferrox magnetite 8610 (300 grams) was added, and the resulting mixture was homogenized by high sheer blending with the Brinkmann polytron at 8,000 rpm for 3 minutes. To the mixture was added one liter of 0.12 percent aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33.0 grams) and water (80 milliliters) was then added over a period of 10 minutes with constant stirring. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder-forming hydrosilylation. The temperature of the mixture was gradually increased from room temperature to a final temperature of 90° C. over a period of 5.5 hours. The wet toner obtained was washed and spray dried in accordance with the procedure as described in Example I. The collected dry toner (328.0 grams) was screened through a 63 micron sieve, and particle size measurement by Coulter Counter gave a volume average particle diameter of 17.3 microns with a volume average particle size dispersity of 1.29.

Two hundred and forty (240) grams of the above toner was dry blended and machine evaluated in accordance with the procedure of Example I. This toner provided an image fix level of over 80 percent (81 percent) without image ghosting or background. In addition, the toner displayed excellent powder flow properties, and did not agglomerate on standing for 56 hours.

EXAMPLE IV

Tetramethyldisiloxane (69.0 grams), allyl methacrylate (65.0 grams), chloroplatinic acid catalyst (100 milligrams), and Isonate 143-L (47.0 grams) were mixed in a 2 liter container with a Brinkmann polytron equipped with a PT 35/4 probe at 4,000 rpm for 30 seconds. Bayferrox magnetite 8610 (300 grams) was then added, and the resulting mixture was homogenized by high sheer blending with the Brinkmann polytron at 8,000 rpm for 3 minutes. To the mixture was added one liter of 0.12 percent aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33.0 grams) and water (80 milliliters) was then added over a period of 10 minutes with constant stirring. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder-forming hydrosilylation. The temperature of the mixture was gradually raised from room temperature to a final temperature of 90° C. over a period of 5.5 hours. The wet toner obtained was washed and spray dried by repeating the procedure as described in Example I. The collected dry toner (305.0 grams) was screened through a 63 micron sieve; and particle size measurement by Coulter Counter provided a volume average particle diameter of 14.9 microns with a volume average particle size dispersity of 1.29.

Two hundred and forty (240) grams of the above encapsulated toner was dry blended and machine evaluated by repeating the procedure as described in Example I. For this toner, an image fix level of 77 percent was obtained, together with clean image background and no image ghosting. The toner also did not agglomerate in storage or in the printer development housing for 48 hours.

EXAMPLE V

Hydride-terminated polydimethylsiloxane (molecular weight 400; from Petrarch Inc.) (97.0 grams), allyl methacrylate (23.0 grams), nickel chloride (3 milligrams), and Isonate 143-L (47.0 grams) were mixed in a 2 liter container with a Brinkmann polytron equipped with a PT 35/4 probe at 4,000 rpm for 30 seconds. Bayferrox magnetite 8610 (300 grams) was then added, and the resulting mixture was homogenized by high sheer blending with the Brinkmann polytron at 8,000 rpm for 3 minutes. To the mixture was then added one liter of 0.12 percent aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33.0 grams) and water (80 milliliters) was then added with constant stirring over a period of 10 minutes. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder-forming hydrosilylation. The temperature of the mixture was gradually increased from room temperature to a final temperature of 90° C. over a period of 5.5 hours. The wet toner so obtained was washed and spray-dried in accordance with the procedure of Example I. The collected dry toner (385 grams) was screened through a 63 micron sieve, and particle size measurement by Coulter Counter provided a volume average particle diameter of 12.2 microns with a volume average particle size dispersity of 1.23.

Two hundred and forty (240) grams of the above encapsulated toner were dry blended and machine evaluated in accordance with the procedure of Example V. For this toner, an image fix level of 80 percent was obtained with clean image background and without image ghosting; the toner also exhibited excellent powder flow properties when in use.

EXAMPLE VI

Hydride-terminated polydimethylsiloxane (molecular weight 400, available from Petrarch Inc.) (15.0 grams) hydroxy-terminated polybutadiene (Sartomer R45 M) (105.0 grams), platinic acid catalyst (100 milligrams), and Isonate 143-L (47.1 grams) were mixed in a 2 liter container with a Brinkmann polytron equipped with a PT 35/4 probe at 4,000 rpm for 30 seconds. Bayferrox magnetite 8610 (300 grams) was then added, and the resulting mixture was homogenized by high sheer blending with the Brinkmann polytron at 8,000 rpm for 3 minutes. To the mixture was then added one liter of 0.12 percent aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33 grams) and water (80 milliliters) was added over a period of 10 minutes with constant stirring. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder-forming hydrosilylation. The temperature of the mixture was gradually raised from room temperature to a final temperature of 90° C. over a period of 5.5 hours. The wet toner product was washed and spray dried using the procedure as described in Example I. The collected dry toner (320 grams) was screened through a 63 micron sieve, and particle size measurement by Coulter Counter provided a volume average particle diameter of 24.5 microns with a volume average particle size dispersity of 1.28.

Two hundred and forty (240) grams of the above toner was dry blended and machine evaluated as described in Example I. For this toner, an image fix level of 82 percent was obtained. No image ghosting was observed, and the toner did not agglomerate on standing or in the printer development housing for 56 hours.

EXAMPLE VII

Polydimethylhydrosiloxane (molecular weight 2,270, available from Petrarch Inc.) (15.6 grams), lauryl methacrylate (104.4 grams), platinic acid catalyst (100 milligrams), and Isonate 143-L (47.1 grams) were mixed in a 2 liter container with a Brinkmann polytron equipped with a PT 35/4 probe at 4,000 rpm for 30 seconds. Bayferrox magnetite 8610 (300 grams) was then added, and the resulting mixture was homogenized by high sheer blending with the Brinkmann polytron at 8,000 rpm for 3 minutes. To the mixture was then added one liter of 0.12 percent aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33.0 grams) and water (80 milliliters) were then added over a period of 10 minutes with constant stirring. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder-forming hydrosilylation. The temperature of the mixture was gradually raised from room temperature to a final temperature of 90° C. over a period of 5.5 hours. The wet toner product was washed and spray dried by repeating the procedure as described in Example I. The collected dry toner (245 grams) was screened through a 63 micron sieve, and Coulter Counter measurement of the toner provided a volume average particle diameter of 22.6 microns with a volume average particle size dispersity of 1.25.

Two hundred and forty (240) grams of the above encapsulated toner was dry-blended and machine evaluated as described in Example I. For this toner, an image fix of 78 percent was obtained, and no signs of image ghosting or toner agglomeration were observed.

EXAMPLE VIII

Tetramethyldisiloxane (43.0 grams), diallyl sebacoate (85.0 grams), platinic acid catalyst (100 milligrams), and Isonate 143-L (47.1 grams) were mixed in a 2 liter container with a Brinkmann polytron equipped with a PT 35/4 probe at 4,000 rpm for 30 seconds. Bayferrox magnetite 8610 (300 grams) was then added, and the resulting mixture was homogenized by high sheer blending using the same Brinkmann polytron at 8,000 rpm for 3 minutes. To the mixture was then added one liter of 0.12 percent aqueous poly(vinyl alcohol) (88 percent hydrolyzed; MW, molecular weight average of 96,000) solution, and thereafter, the mixture was blended at 9,000 rpm with an IKA polytron equipped with a T45/4G probe for 2 minutes. A solution of 1,4-bis(3-aminopropyl)piperazine (33.0 grams) and water (80 milliliters) was then added over a period of 10 minutes with constant stirring. Subsequently, the mixture was transferred to a 2 liter reaction kettle and was mechanically stirred at room temperature for approximately 1 hour to complete the shell forming polycondensation reaction. Thereafter, the mixture was heated in an oil bath to initiate the core binder-forming hydrosilylation. The temperature of the mixture was gradually increased from room temperature to a final temperature of 90° C. over a period of 5.5 hours. The wet toner product was washed and spray-dried using the procedure as described in Example I. The collected dry toner (342 grams) was screened through a 63 micron sieve, and Coulter Counter measurement provided a volume average particle diameter of 17.1 microns with a volume average particle size dispersity of 1.32.

Two hundred and forty (240) grams of the above encapsulated toner was dry blended and evaluated as described in Example I. For this toner, the image fix level was 83 percent; no image ghosting or toner agglomeration were observed. The toner also displayed excellent powder flow properties.

Other modifications of the present invention may occur to those skilled in the art subsequent to a review of the present application. The aforementioned modifications, including equivalents thereof, are intended to be included within the scope of the present invention.

What is claimed is:

1. An encapsulated toner composition comprised of a core comprised of a siloxane-containing resin obtained from the hydrosilylation of olefins, pigment, dyes, or mixtures thereof; and a polymeric shell prepared by interfacial polymerization.

2. A toner in accordance with claim 1 wherein the siloxane-containing core resin is present in an amount of from about 15 to about 95 weight percent.

3. A toner in accordance with claim 1 wherein the core resin is formed by condensation polymerization.

4. An encapsulated toner in accordance with claim 1 wherein the core resin is formed by polyhydrosilylation.

5. A toner in accordance with claim 1 wherein the siloxane-containing resin is derived from the hydrosilylation of an olefin.

6. An encapsulated toner in accordance with claim 1 wherein the core resin formation is achieved by hydrosilylation, and the shell formation is accomplished by a condensation polymerization.

7. An encapsulated toner composition comprised of a core comprised of a resin binder formed by the hydrosilylation reaction of an olefin, pigment, dyes, or mixtures thereof; and a polymeric shell.

8. An encapsulated toner composition in accordance with claim 7 wherein the core is comprised of a resin binder formed by the hydrosilylation of a diolefin with a bis(silylhydride).

9. An encapsulated toner composition comprised of a core comprised of a resin binder formed from the hydrosilylation of an olefin and a poly(silylhydride) macromer in the presence of a hydrosilylation catalyst, pigment, dyes, or mixtures thereof; and a polymeric shell prepared by interfacial polymerization.

10. An encapsulated toner composition in accordance with claim 9 wherein the core is comprised of a resin binder formed by hydrosilylation of a polyolefin.

11. An encapsulated toner composition in accordance with claim 10 wherein the core is comprised of a resin binder formed by hydrosilylation of a diolefin or polyolefin with a silylhydride-functionalized component in the presence of a hydrosilylation catalyst, pigment, dyes, or mixtures thereof; and a polymeric shell.

12. An encapsulated toner composition in accordance with claim 11 wherein the silylhydride-functionalized component is selected from the group consisting of diphenylmethylsilane, trimethylsilane, triethylsilane, trioctylsilane, trimethoxysilane, triethyoxysilane, diphenylsilane, dimethylsilane, diethylsilane, dipropylsilane, dibutylsilane, dipentysilane, dihexylsilane, dioctylsilane, diisopropylsilane, tetramethyldisiloxane, tetraethyldisiloxane, tetrapropyldisiloxane, tetrabutyldisiloxane, tetrapentyldisiloxane, tetramethyldisilylethylene, silylhydride-terminated polydimethylsiloxanes, polymethylhydrosiloxanes, polymethylhydrosiloxane copolymers, and alkoxy and siloxy-terminated hydrosiloxane polymers.

13. A toner in accordance with claim 11 wherein the hydrosilylation catalyst is selected from the group consisting of molybdic acid, chloroplatinic acid, dichlorobis(ethylenedichloro) platinum, ehtylene bis(triphenylphosphino) platinum, ethylene tris(cyclohexylphosphino) platinum, potassium trichloro platinum-dimethylsulfoxide complex, dicobaltoctacarbonyl, bis(triphenylphosphino)dichloro nickel, ethyl dichlorobis(dimethylamino) nickel, dichlorodipyridine nickel, dichlorobis(dimethylphosphino) ferrocene, dichlorobis(tributylphosphino) nickel, tetrakis(triphenylphosphino) nickel, dichlorotetraaniline nickel, Iron pentacarbonyl, manganese acetoacetate, ferrous acetoacetate, cobalt acetoacetate, bis(cycloocta-1,5-diene) nickel, chlorotris(triphenylphosphino) rhodium, chorotris(cyclohexylphosphino) rhodium, octacarbonyl dicobalt dihydrogen hexachloro osmium, rhodium trichloride, ruthenium trichloride, ferric chloride, nickel chloride, and dihydrogen hexachloro iridium.

14. A toner in accordance with claim 1 containing surface additives.

15. A toner in accordance with claim 14 wherein the surface additives are metal salts, metal salts of fatty acids, silicas, or mixtures thereof.

16. A toner in accordance with claim 15 wherein the surface additives are present in an amount of from about 0.1 to about 10 weight percent.

17. A toner in accordance with claim 15 wherein zinc stearate is selected as the surface additive.

18. A toner in accordance with claim 1 containing conductive components on the surface thereof.

19. A toner in accordance with claim 18 wherein the conductive components are carbon black, graphite, or mixtures thereof.

20. A toner in accordance with claim 1 wherein the toner has an average diameter of from about 5 to about 30 microns.

21. A toner in accordance with claim 1 wherein the toner geometric size distribution is from about 1.1 to about 2.0.

22. A toner in accordance with claim 1 wherein the shell is a polyurea, a polyurethane, a polyamide, a polyester, or a mixture thereof.

23. A toner in accordance with claim 22 wherein the shell contains conductive components.

24. A toner in accordance with claim 23 wherein the conductive components are comprised of carbon black, graphite, or mixtures thereof.

25. A process for the preparation of encapsulated toners which comprises (1) dispersing in an aqueous medium a mixture of shell precursor components, core resin precursor or precursors, a hydrosilylation catalyst, and pigments, dyes or mixtures thereof into stabilized microdroplets; (2) initiating a shell forming interfacial polymerization by adding a water miscible shell precursor component; (3) effecting core resin hydrosilylation within the newly formed microcapsules by heating the reaction mixture from ambient temperature to about 100° C.; and (4) processing the resulting encapsulated toner product by washing, sieving, drying, and dry blending with surface additives.

26. A process in accordance with claim 25 wherein the shell precursor components represent from 5 to about 30 weight percent, the core resin precursor represents from 15 to about 95 weight percent, the colorants represent from 1 to about 65 weight percent; and the catalyst is present in an effective amount of from about 0.01 to about 1 percent of the core resin precursor.

27. A process for the preparation of encapsulated toners which comprises (1) dispersing in an aqueous medium a mixture of shell precursor components, core resin precursors, a hydrosilylation catalyst, and pigments, dyes, or mixtures thereof into stabilized microdroplets; (2) initiating a shell forming interfacial polymerization by adding a water miscible shell precursor component; and (3) effecting core resin hydrosilylation with the newly formed microcapsules by heating the reaction mixture.

28. A process in accordance with claim 27 wherein the resulting encapsulated toner is further processed by washing, sieving, and drying.

29. A process in accordance with claim 27 wherein there are added to the resulting toner surface additives.

30. A process in accordance with claim 29 wherein the surface additives are selected from the group consisting of colloidal silicas, metal salts of fatty acids, or metal salts.

31. A process in accordance with claim 29 wherein the additives are present in an amount of from about 0.1 to about 1 weight percent.

32. An encapsulated toner composition comprised of a core comprised of a polymer containing a siloxane moiety, which moiety is covalently attached to the polymer, pigment or dye, and a polymeric shell prepared by interfacial polymerization.

33. An encapsulated toner composition in accordance with claim 32 wherein the core is comprised of a siloxane-containing resin obtained by the hydrosilylation of an olefin.

34. An encapsulated toner composition in accordance with claim 32 wherein the core is comprised of a siloxane-containing resin obtained by the hydrosilylation of an olefin or polyolefin with a silylhydride functionalized component in the presence of a hydrosilylation catalyst.

35. An encapsulated toner in accordance with claim 34 wherein the hydrosilylation is accomplished with a bis(silylhydride).

36. An encapsulated toner in accordance with claim 34 wherein the olefin is selected from the group consisting of hexene, heptene, octene, hexadiene, heptadiene, octadiene, cyclopentadiene, divinylether, diallylether, dibutenylether, dipentenylether, dihexenylether, diheptenylether, dioctenylether, vinylbutenylether, vinylhexenylether, allylbutenylether, allylhexenylether, divinylbenzene, diallylbenzene, divinyltoluene, diallyltoluene, divinylnaphthalene, diallylnaphthalene, bis(vinyloxy)benzene, bis(allyloxy)benzene, bis(vinyloxy)toluene, divinyl succinate, divinyl malonate, divinyl glutarate, divinyl adipate, divinyl pimelate, divinyl suberate, divinyl methylglutarate, methyladipate, diallyl succinate, dially glutarate, diallyl adipate, poly(butadiene), styrenebutadiene copolymers, and mixtures thereof.

37. An encapsulated toner in accordance with claim 34 wherein the silylhydride-functionalized component is selected from the group consisting of diphenylmethylsilane, trimethylsilane, triethylsilane, trioctylsilane, trimethoxysilane, triethyoxysilane, diphenylsilane, dimethylsilane, diethylsilane, dipropylsilane, dibutylsilane, dipentylsilane, dihexylsilane, dioctysilane, diisopropylsilane, tetramethyldisiloxane, tetraethyldisiloxane, tetrapropyldisiloxane, tetrabutyldisiloxane, tetrapentyldisiloxane, tetramethyldisilylethylene, silylhydride-terminated polydimethylsiloxanes, polymethylhydrosiloxanes, polymethylhdrosiloxane copolymers, an alkoxy terminated hydrosiloxane polymer, and a siloxy-terminated hydrosiloxane polymer.

38. An encapsulated toner in accordance with claim 34 wherein the hydrosilylation catalyst is selected from the group consisting of molybdic acid, chloroplatinic acid, dichlorobis(ethylenedichloro) platinum, ethylene bis(triphenylphosphino) platinum, ethylene tris(cyclohexylphosphino) platinum, potassium trichloro platinum-dimethylsulfoxide complex, dicobaltoctacarbonyl, bis(triphenylphosphino)dichloro nickel, ethyl dichlorobis(dimethylamino) nickel, dichlorodipyridine nickel, dichlorobis(dimethylphosphino) ferrocene, dichlorobis(tributylphosphino) nickel, tetrakis(triphenylphosphino) nickel, dichlorotetraaniline nickel, iron pentacarbonyl, manganese acetoacetate, ferrous acetoacetate, cobalt acetoacetate, bis(cycloocta-1,5-diene) nickel, chlorotris(triphenylphosphino) rhodium, chorotris(cyclohexylphosphino) rhodium, octacarbonyl dicobalt dihydrogen hexachloro osmium, rhodium trichloride, ruthenium trichloride, ferric chloride, nickel chloride, and dihydrogen hexachloro iridium.

39. An encapsulated toner in accordance with claim 34 wherein the shell contains a conductive component.

40. An encapsulated toner in accordance with claim 39 wherein the conductive component is selected from the group consisting of carbon black, graphite, or mixtures thereof.

41. An encapsulated toner in accordance with claim 39 wherein the conductivity thereof is from about $10^3$ to about $10^8$ ohm-cm.

42. A toner in accordance with claim 1 wherein the pigment is carbon black, magnetite, or mixtures thereof.

43. A toner in accordance with claim 1 wherein the pigment is cyan, yellow, magenta, or mixtures thereof; red, green, blue, brown, or mixtures thereof.

44. A toner in accordance with claim 1 wherein the olefin is selected from the group consisting of hexene, heptene, octene, hexadiene, heptadiene, octadiene, cyclopentadiene, divinylether, diallylether, dibutenylether, dipentenylether, dihexenylether, diheptenylether, dioctenylether, vinylbutenylether, vinylhexenylether, allylbutenylether, allylhexenylether, divinylbenzene, diallylbenzene, divinyltoluene, diallyltoluene, divinylnaphthalene, diallylnaphthalene, bis(vinyloxy)benzene, bis(allyloxy)benzene, bis(vinyloxy)toluene, divinyl succinate, divinyl malonate, divinyl glutarate, divinyl adipate, divinyl pimelate, divinyl suberate, divinyl methylglutarate, methyladipate, diallyl succinate, diallyl glutarate, diallyl adipate, poly(butadiene), styrenebutadiene copolymers, and mixtures thereof.

45. A toner in accordance with claim 7 wherein the pigment is carbon black, magnetite, or mixtures thereof.

46. A toner in accordance with claim 7 wherein the pigment is cyan, yellow, magenta, or mixtures thereof; red, green, blue, brown, or mixtures thereof.

47. A toner in accordance with claim 7 wherein the olefin is selected from the group consisting of hexene, heptene, octene, hexadiene, heptadiene, octadiene, cyclopentadiene, divinylether, diallylether, dibutenylether, dipentenylether, dihexenylether, diheptenylether, dioctenylether, vinylbutenylether, vinylhexenylether, allylbutenylether, allylhexenylether, divinylbenzene, diallylbenzene, divinyltoluene, diallyltoluene, divinylnaphthalene, diallylnaphthalene, bis(vinyloxy)benzene, bis(allyloxy)benzene, bis(vinyloxy)toluene, divinyl succinate, divinyl malonate, divinyl glutarate, divinyl adipate, divinyl pimelate, divinyl suberate, divinyl methylglutarate, methyladipate, diallyl succinate, dially glutarate, diallyl adipate, poly(butadiene), a styrenebutadiene copolymer, and mixtures thereof.

48. An encapsulated toner composition comprised of a core comprised of a polymer and covalently attached thereto by reaction thereof of a siloxane moiety, pigment, and wherein the core is encapsulated within a polymeric shell.

49. An encapsulated toner in accordance with claim 48 wherein the core is obtained from the hydrosilylation of olefins.

50. An encapsulated toner obtained by the process of claim 25.

51. An encapsulated toner in accordance with claim 48 wherein the core is comprised of the reaction of a silylhydride, a bis(silylhydride) or a poly(silylhydride) functionalized siloxane or polysiloxane with an olefinic component.

52. A toner in accordance with claim 7 wherein the olefin is selected from the group consisting of hexene, heptene, octene, hexadiene, heptadiene, octadiene, cyclopentadiene, divinylether, diallylether, dibutenylether, dipentenylether, dihexenylether, diheptenylether, dioctenylether, vinylbutenylether, vinylhexenylether, allylbutenylether, allylhexenylether, divinylbenzene, diallylbenzene, divinyltoluene, diallyltoluene, divinylnaphthalene, diallylnaphthalene, bis(vinyloxy)benzene, bis(allyloxy)benzene, bis(vinyloxy)toluene, divinyl succinate, divinyl malonate, divinyl glutarate, divinyl adipate, divinyl pimelate, divinyl suberate, divinyl methylglutarate, methyladipate, diallyl succinate, diallyl glutarate, dially adipate, poly(butadiene), styrenebutadiene copolymers, and mixtures thereof.

* * * * *